US005266159A

United States Patent [19]

Greenwood et al.

[11] Patent Number: 5,266,159

[45] Date of Patent: Nov. 30, 1993

[54] MASS FLOW MEASUREMENT, PREFERABLY FOR CONTROLLING CHIP FEED TO A DIGESTER

[75] Inventors: Brian Greenwood; Andries Daamen, both of Glens Falls, N.Y.; Gene Graham, New Augusta, Miss.

[73] Assignee: Kamyr, Inc., Glens Falls, N.Y.

[21] Appl. No.: 782,828

[22] Filed: Oct. 25, 1991

[51] Int. Cl.[5] ..... D21C 3/26

[52] U.S. Cl. ..... 162/17; 162/52; 162/246; 162/198; 162/262; 162/263; 162/252

[58] Field of Search ..... 162/52, 49, 246, 198, 162/252, 262, 263, 17; 250/358.1, 308, 390.06, 359.1

[56] References Cited

U.S. PATENT DOCUMENTS

| | | | |
|---|---|---|---|
| 3,822,179 | 7/1974 | Chari | 162/17 |
| 3,898,124 | 8/1975 | Olson | 162/463 |
| 4,071,399 | 1/1978 | Prough | 162/17 |
| 4,239,590 | 12/1980 | Prough | 162/49 |
| 4,506,541 | 3/1985 | Cunningham | 250/308 |
| 4,582,992 | 4/1986 | Atwell | 250/358.1 |

FOREIGN PATENT DOCUMENTS

| | | | |
|---|---|---|---|
| 919289 | 5/1971 | Canada | 162/DIG. 10 |
| 0926131 | 5/1982 | U.S.S.R. | 162/49 |

*Primary Examiner*—W. Gary Jones
*Assistant Examiner*—Branda Lamb
*Attorney, Agent, or Firm*—Nixon & Vanderhye

[57] ABSTRACT

A method and system are provided for controlling the feed of comminuted cellulosic fibrous material (e.g. wood chips) to a continuous digester utilizing a chips meter of variable speed. A quality of the chips related to mass flow—preferably density—is continuously determined, preferably while the material is in free fall, not immersed in liquid. The speed of the material meter is controlled in response to the quality determined to provide a target mass flow of material from the meter to the digester. A nuclear type density gauge may be utilized having a source and a detector mounted on opposite sides of a chip chute, and above the level of liquid in a chip chute so that density is determined during free fall of the chips, not immersed in liquid. A level sensor may also be associated with the chip chute with a shield between the nuclear source and the level sensor. The chip meter speed is controlled in the range of about 0–16 rpm.

8 Claims, 5 Drawing Sheets

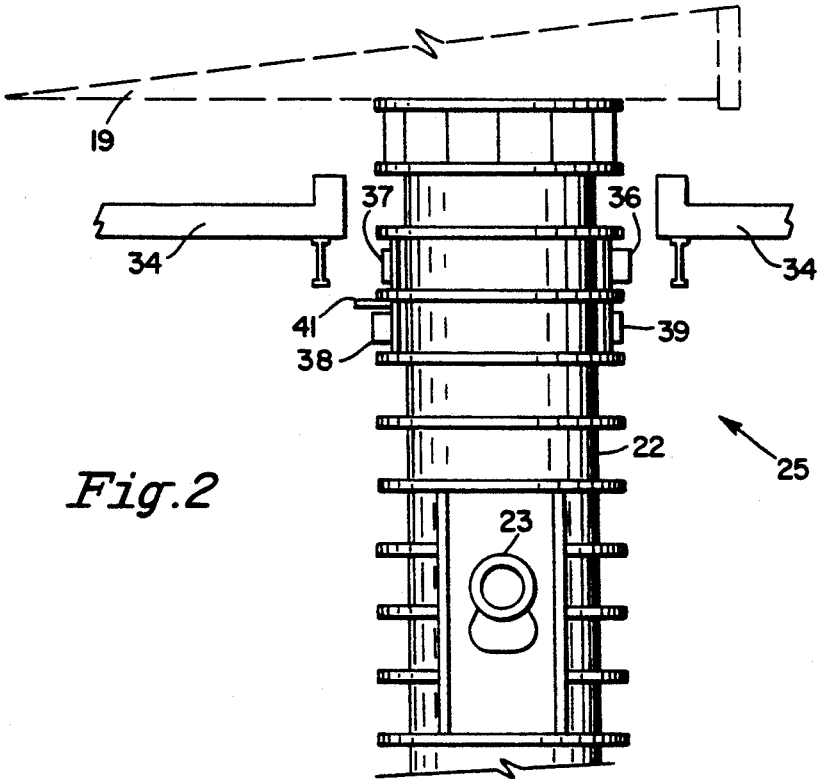
Fig.2
Fig.8
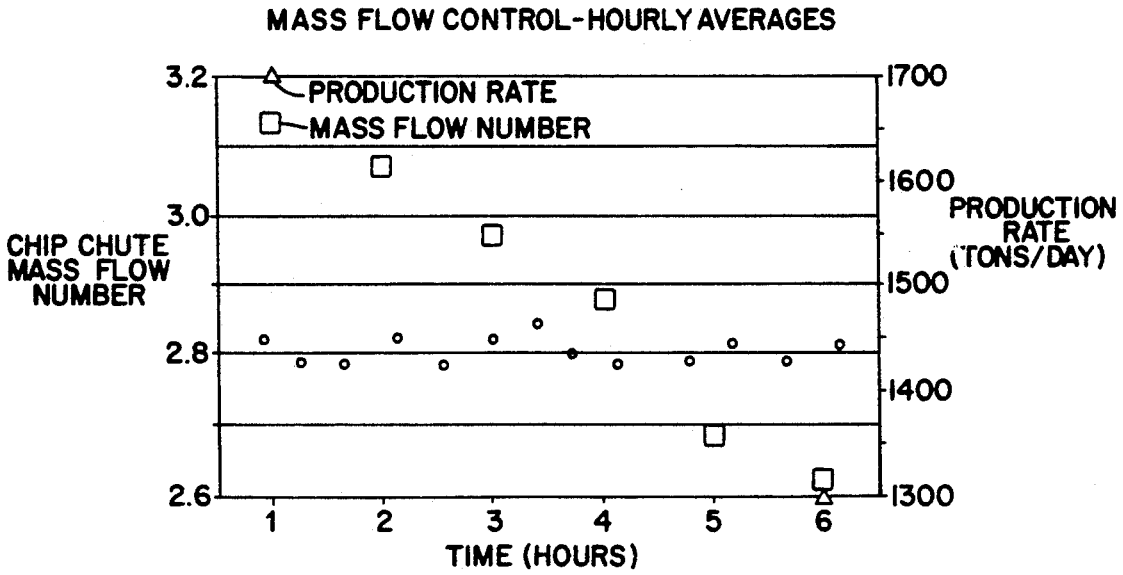

MASS FLOW MEASUREMENT, PREFERABLY FOR CONTROLLING CHIP FEED TO A DIGESTER

BACKGROUND AND SUMMARY OF THE INVENTION

The production of paper pulp or the like utilizing a continuous digester is susceptible to a wide variety of conditions. In many situations, when the chips are steamed and fed from a high pressure feeder to the continuous digester, a chip meter operates continuously at a constant speed. However it has been found that such an operation is far from optimal, and—depending upon the mass flow to the digester—can cause a greatly varying production rate of pulp from comminuted cellulosic fibrous material.

According to the present invention, it has been determined that by controlling the mass flow to a continuous digester production can be increased and a number of other advantages achieved. According to the present invention, the mass flow of the chips—or other comminuted cellulosic fibrous material—to the digester is controlled by controlling the chips meter that feeds the chips from a source ultimately to the continuous digester. Utilizing the invention it is possible to achieve a significant increase in production while using the same white liquor charge rate. Also, more stable Kappa numbers and digester level control can be achieved.

According to one aspect of the present invention a method of controlling the feed of comminuted cellulosic fibrous material to a continuous digester utilizing a material meter of variable speed is provided. The method comprises the steps of: (a) Substantially continuously feeding comminuted cellulosic fibrous material from the material meter to the continuous digester. (b) During the practice of step (a), substantially continuously determining a quality related to mass flow of the material being fed. And, (c) substantially continuously controlling the speed of the material meter in response to step (b) to provide a target mass flow of material fed from the meter to the continuous digester. Preferably, the quality to be determined that is related (e.g. proportional) to mass flow is the density of the material being fed. In order to more simply determine the density, it is determined in a point in the sequence where the material is not immersed in liquid, but is essentially free falling. In a conventional system this density determination is practiced at the conventional chip chute, above the level of liquid in the chip chute. A liquid level sensor for sensing an overfill condition also is preferably provided at the chip chute, and according to the method of the present invention is shielded from the density detecting equipment, which preferably comprises a nuclear type density gauge. Step (c) is preferably practiced to control the material meter speed so that it is in the range of about 0 to 16 rpm.

According to another aspect of the present invention a system for processing comminuted cellulosic fibrous material is provided. The system comprises: A conduit for conveying comminuted cellulosic fibrous material. A material meter connected to the conduit for metering the flow of material to the conduit. A continuous digester. Means for substantially continuously transferring material from the conduit to the digester. Means for determining the density of the material flowing in the conduit. And, means for controlling the meter in response to the density determining means to provide a target mass flow of material fed from the meter to the digester. Preferably the conduit comprises a chute with a steaming vessel connected to the chute opposite the meter. The density determining means comprises a nuclear type density gauge having a source and a detector mounted opposite each other to the chute. A liquid level sensor, with a shielding means between the source and the liquid level sensor, may be provided.

According to yet another aspect of the present invention a chip chute is provided. The chip chute comprises: Means at the top and bottom of the chip chute for respectively connecting the chip chute to other devices for acting on the chips. A nuclear type density gauge comprising a source and a detector mounted on opposite sides of the chute, to the chute. A liquid level sensor associated with the chute. And, shielding means between the source and the level sensor.

It is the primary object of the present invention to provide for the effective control of cellulosic fibrous material fed to a continuous digester in order to maximize production and obtain other advantages. This and other objects of the invention will become clear from an inspection of the detailed description of the invention and from the appended claims.

BRIEF DESCRIPTION OF THE DRAWINGS

FIG. 2 is a detail side view showing the location of the density gauge and related components on a chip chute, according to the present invention;

FIG. 8 is a graphical representation of the results achievable according to the invention compared to a situation when the invention is not utilized.

DETAILED DESCRIPTION OF THE DRAWINGS

Figure 1:
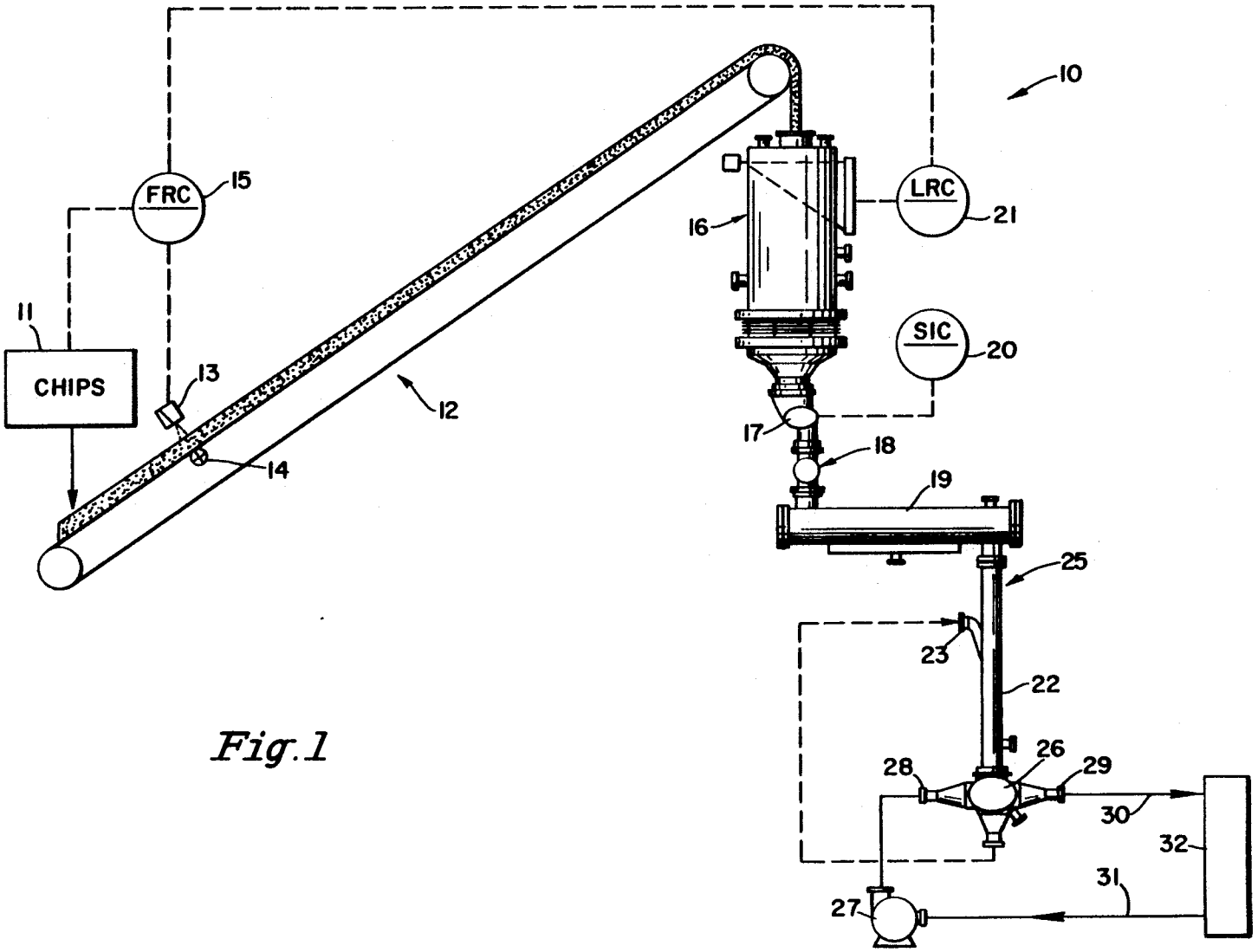
FIG. 1 is a side schematic view of an exemplary system according to the present invention.

FIGS. 1 and 2 illustrate the basic apparatus utilized in the practice of the method according to the invention and comprising the system according to the invention. All the individual components of the system are per se conventional. The system is shown generally at reference numeral 10 in FIG. 1, while the modifications provided according to the present invention are illustrated most clearly in FIG. 2.

While in the present description the term "chips" will be utilized, it is to be understood that the invention may be practiced utilizing any comminuted cellulosic fibrous material, although it is particularly applicable to the production of paper pulp using softwood and hardwood chips.

As illustrated in FIG. 1, a conventional source of chips 11 is provided associated with a chips conveyor belt 12. Associated with the chip belt 12 is a gamma source 13 and a gamma detector 14 which operate the controller 15 to determine the amount of chips fed from source 11 onto the belt 12. From the belt 12 the chips are discharged into a conventional chips bin 16, preferably of the vibratory type which may include steaming therein, and from the bin 16 they are discharged utilizing a variable speed chip meter 17 through a low pressure feeder 18 into a horizontal steaming vessel 19. The controllers 20, 21 are associated with the chips bin 16 and the meter 17.

Connected to the bottom of the steaming vessel 19, at the outlet thereof, is a vertical conventional chip chute 22 having an inlet 23 thereto. At area 25 thereof apparatus according to the invention (which will be described with respect to FIG. 2) is provided. The bottom of the chip chute 22 is connected to the high pressure feeder 26 which is fed with high pressure liquid from pump 27 into inlet 28, with the chips entrained in high pressure liquid being pumped out through outlet 29 into line 30 to continuous digester 32, liquid from the digester 32 being returned via line 31 to the pump 27.

What has been described above is entirely conventional. According to the invention, apparatus is provided for utilizing the mass flow of chips from the meter 17 to the continuous digester 32 to control production. In the preferred embodiment illustrated, the chip chute 22 extends through the floor 34 beneath the steaming vessel 19, and an overflow level detector comprising a source 36 and detector element 37 are mounted on opposite sides of the chip chute 22. Typically the level of liquid in the chip chute 22 is at or just below the inlet 23. Mounted just below the overflow level detector assembly 36, 37 is a nuclear type density gauge comprising a density source 38 and a detector 39. While there may be a number of instruments that are suitable for this purpose, a particularly useful one is a Texas Nuclear SGD series density gauge. Such an instrument is capable of sensing the density of the chips free falling in the chute 22, not immersed in liquid, in the range of 0–5 lbs. per cubic foot. Such an instrument has a microprocessor based transmitter that is set up with a long time constant of about eight seconds to smooth variations in density readings from possible surges as the chips fall from the steaming vessel 19.

Because the high level sensor 36, 37 also is typically a nuclear device, and because of the close proximity of the density gauge 38, 39 thereto, it is highly desirable to use a shielding means—such as a lead plate 41 up about one inch thick—disposed between the elements 37, 38 as illustrated in FIG. 2.

The location of the gauge 38, 39, is preferably at a point where the chips are not immersed in liquid in order to make the density determination as simple and as error free as possible. While of course there will be some liquid in the form of condensed steam associated with the chips as they free fall from the steaming vessel 19 in the chute 22, they will not be immersed in liquid since the liquid level in the chute 22 is—except for aberrant conditions—below the position of the density gauge 38, 39. Thus the most accurate density sensing possible can be achieved by positioning the nuclear gauge 38, 39 as illustrated in FIG. 2. Since the density is proportional to the mass flow rate, information from the density gauge 38, 39 may be utilized to control the speed of the chip meter 17 so as to optimize production and to gain other advantages.

Figure 3:
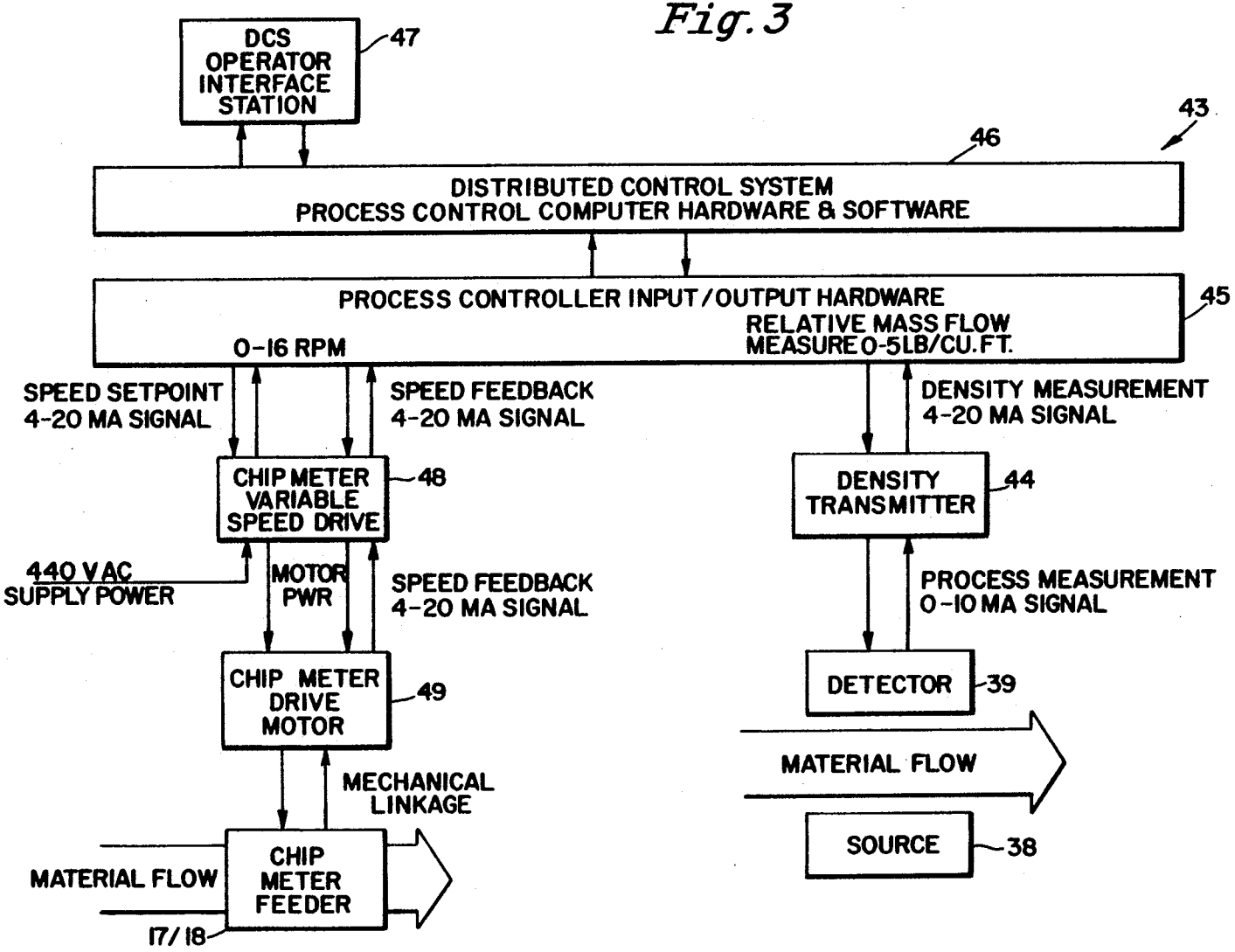
FIGS. 3 through 7 are control schematics illustrating various control interconnections between components of the system according to the invention.

FIGS. 3 through 7 provide various control schematics illustrating the actual implementation of the control of the speed of the chips meter 17 in response to the density sensing. For example FIG. 3 shows a mass flow measurement to control the chip feed to digester electrical loop schematic. The material flow in the chute 22 is sensed utilizing a source 38 and detector 39, which use in operative association with the components illustrated generally by reference numeral 43. The density transmitter 44 is in communication with the process controller input/output hardware 45, which in turn is in operative association with the distributed control system process control computer hardware and software 46. An operator interface station 47 is provided as indicated. The relative mass flow measurement is typically between 0–5 lbs. per cubic foot, and the speed of operation of the chip feeder 17 is 0 to 16 rpm. The chip meter variable speed drive 48 communicates with the process controller 45, and controls the chips meter drive motor 49.

Figure 4:
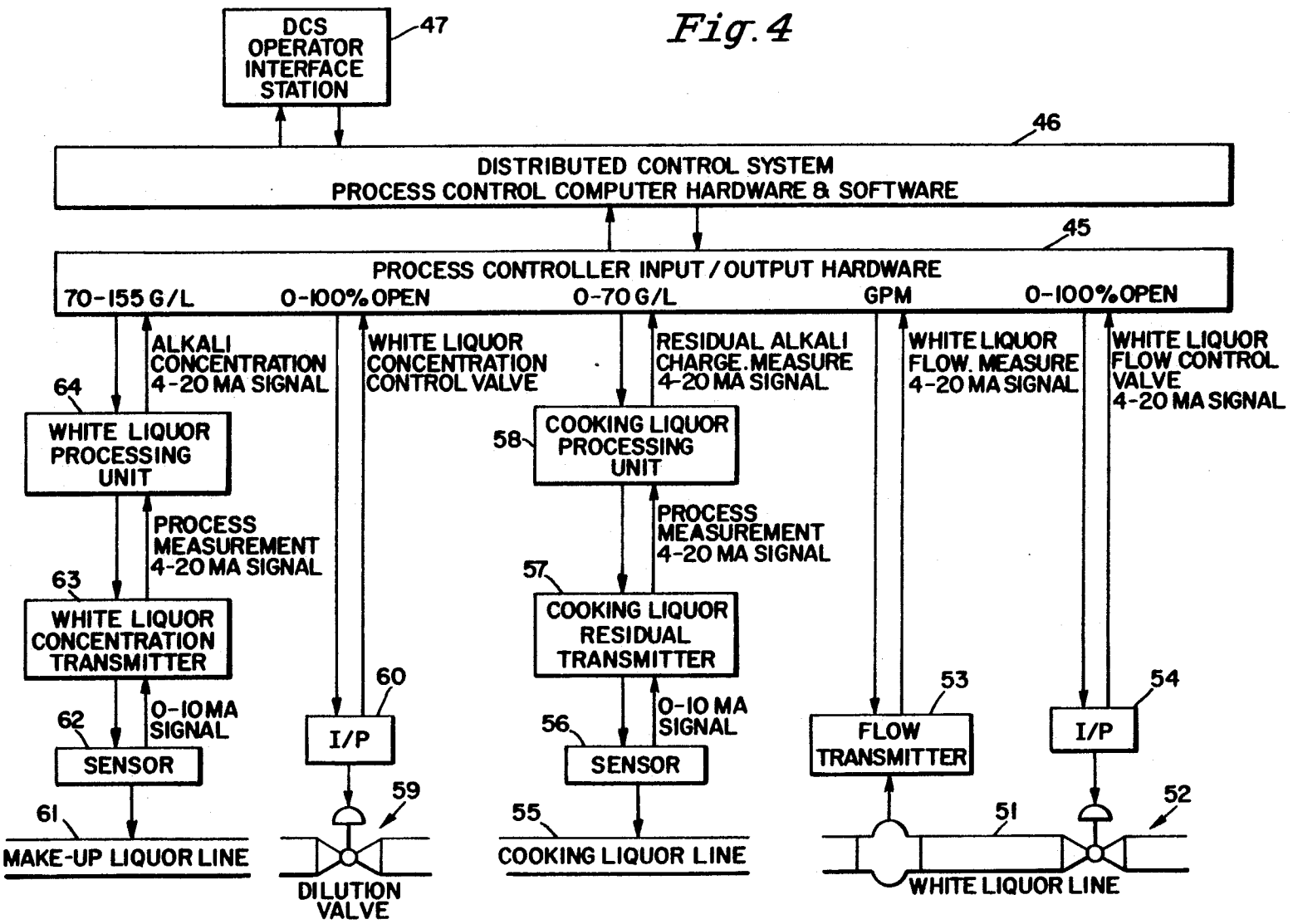

FIG. 4 provides a mass flow measurement to control chip feed to digester alkali charge measurement and control electrical loop schematic. This illustrates—schematically—a white liquor line 51 having a valve 52 therein, with a flow transmitter 53 communicating with the process controller 45 from line 51, and the I/P 54 communicating with the controller 45. Also cooking liquor line 55 is provided associated with a sensor 56, a cooking liquor residual transmitter 57, a cooking liquor processing unit 58, and the like, which also communicate with the process controller 45. Similarly a dilution valve 59 communicating with the process controller 45 through the I/P 60 is provided. Make-up liquor line 61 is associated with a sensor 62 and a white liquor concentration transmitter 63, and is connected through a white liquor processing unit 64 to the process controller 45. Utilizing these components, the proper level of cooking liquor and white liquor are provided to the material depending upon the mass flow rate.

Figure 5:
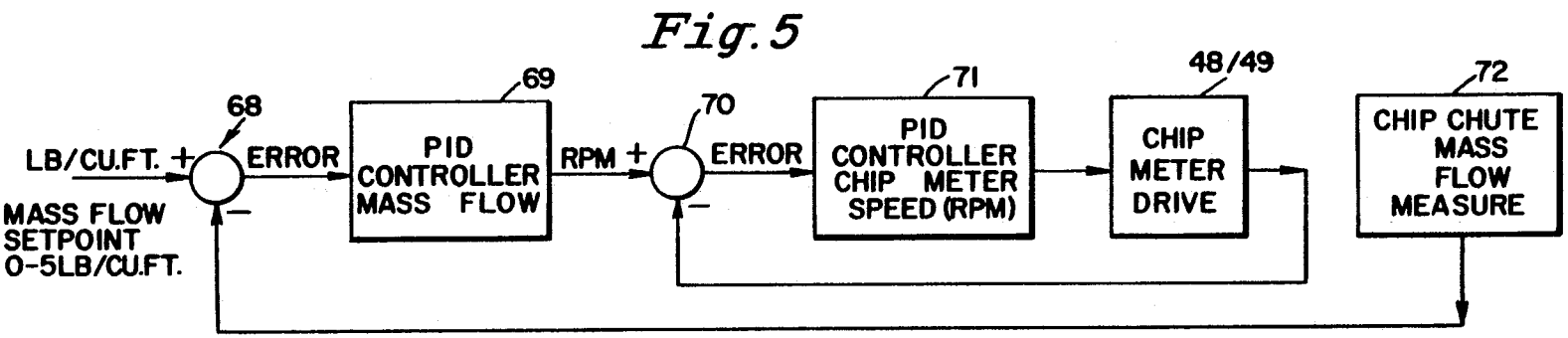
Figure 6:
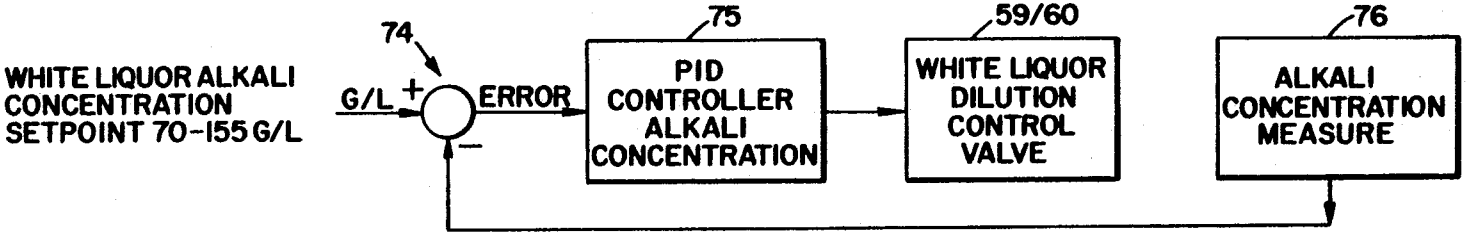
Figure 7:
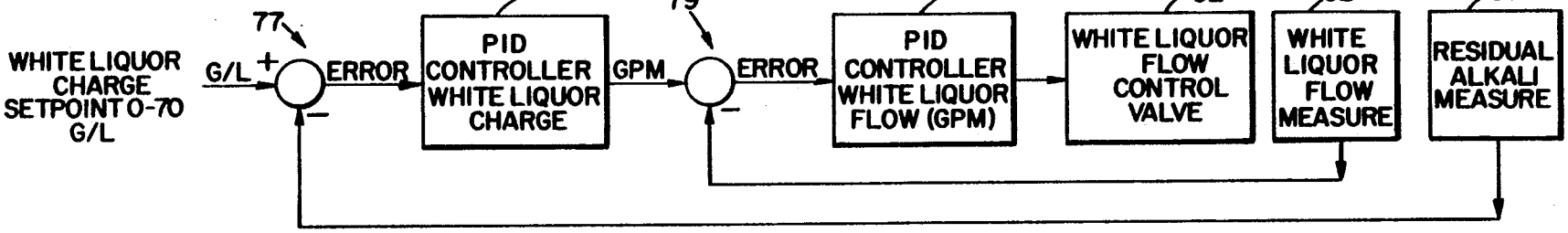

FIGS. 5 through 7 provide a basic functional control loop schematic for the mass flow control algorithms for chip feed to the digester. Element 68 schematically illustrates the mass flow set point, which is between 0–5 lbs. per cubic foot operating through a PID controller for the mass flow 69, through element 70 to PID controller for the chip meter speed, and the chip meter drive 48/49. The chip chute for mass flow measurement 72 is provided utilizing the density gauge 38, 39. FIGS. 6 and 7 illustrate the same basic functional control loop schematic for the white liquor or alkali concentration and the white liquor charge set points.

Control of mass flow will vary the feed rate of material into the continuous digester system and will set the production rate for the entire system. Thus when the operator sets the mass flow target for a particular period the production rate has been set and any other process variables will be adjusted in proportion to the feed rate—either manually, or—by the development control software algorithms—automatically. A general list of the process variables which vary in proportion to feed rate include the white liquor charge (to maintain liquor to wood ratio), the alkali concentration (to maintain alkali to wood ratio), the high pressure feeder speed (to transfer incoming material to the digester), the impregnation vessel sluice flow (to maintain chip digester rate from the impregnation vessel), digester extraction flow (to maintain dilution factors), the blow flow rate (to maintain constant cooking time and H-factor), cooking zone temperature (to maintain H-factor), wash circulation flow (to maintain countercurrent wash flow target), etc.

In some mills, the amount of white liquor charged into the process is the limiting factor for the production rate. In such a situation, the operator will set the mass flow target to a level that maximizes the production for the maximum allowable level that the white liquor charge can support. In other mills, a possible production control scheme could be set up which cascades chip meter speed with chip meter mass flow and cascades mass flow with impregnation vessel chip level.

That is, the chip meter speed controller would receive its set point from the chip mass flow controller and the chip mass flow controller receives its set point from the impregnation vessel of the controller. Digester level control would be maintained for a constant blow flow set point by varying the bottom circulation flow to the top of the digester. Also in such a situation the white liquor charged to the digester would be based upon the residual active alkali analyzer on the bottom circulation line.

FIG. 8 schematically illustrates the difference between operation according to the invention and operation without the invention. While the absolute values illustrated in FIG. 8 are not intended to be actual production numbers, the relative schematical representations simulate actual tests. As can be seen from the inspection of the square shaped data points, when the chip meter speed is set at a constant value—e.g. 13.5 rpm—in working from the top of a chips pile to the bottom of the pile, production rate can vary dramatically. In FIG. 8 the production rate varies from about 1700 tons per day to about 1300 tons per day over about a seven hour period, a drop of 400 tons per day in rate. However utilizing the mass flow control of a chip feed according to the invention—where the chip meter speed varies depending upon the density determinations utilizing the gauge 38, 39, so as to keep the mass flow rate about constant—the production rate is maintained at about the same level, as is indicated by the circular schematic data points in FIG. 8.

The invention is—as earlier described—applicable to almost all types of comminuted cellulosic fibrous material. However there must be adaptations depending upon the material. For changes from hardwood to softwood about thirty minutes is required for the operator to reset the mass flow target for the new furnish. During the species change, the mass flow controller is put in manual until the process stabilizes. Then the operator adjusts the mass flow set point to again maximize production for a given white liquor charge rate.

Under some circumstances—such as a very heavy rain—the chips will be carried in with a small volume of water. During these conditions the density measurements are not as accurate since there is more liquid contained with the chips, which throws the readings of gauge 38, 39 off. That is, typically the density measurements show mass flow decreasing and thus the chip meter speed increases. During such conditions, it is desirable for the operator to put the mass flow controller into manual for a short period of time until the problem corrects itself or the heavy rain passes, and then go back to controlling by mass flow again.

In addition to stabilized and optimum production, according to the present invention the inherent errors in chip meter pocket fill factor and packing at varying speeds can be ignored. Also the flow through the impregnation vessel and digester are stabilized, which will stabilize liquor heater temperature control and extraction flows, with an ultimate improved and stable Kappa number. Optimized production, and more stable Kappa numbers and digester level control are significant advantages that are accomplished according to the invention in a simple and cost-effective manner.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of controlling the feed of comminuted cellulosic fibrous material to a continuous digester using a material meter of variable speed, comprising the steps of:

(a) substantially continuously feeding comminuted cellulosic fibrous material from the material meter to the continuous digester;

(b) during the practice of step (a), substantially continuously determining the density of the material being fed, utilizing a chute having a level of liquid therein, by passing a stream of nuclear particles through the flow of material to determine its density, and detecting the relative amount of particles passing through the stream;

(c) substantially continuously controlling the speed of the material meter in response to step (b) to provide a target density of material fed from the meter to the continuous digester;

(d) sensing the level of liquid in the chute with a level sensor; and (e) shielding the level sensor from the nuclear particles.

2. A method as recited in claim 1 comprising a further step of steaming the material during the practice of step (a).

3. A method as recited in claim 1 wherein step (c) is practiced to control the material meter speed so that it is in the range of 0–16 rpm.

4. A method as recited in claim 1 wherein step (b) is practiced by determining the density of the material while it is in free fall, not immersed in liquid.

5. A method as recited in claim 4 wherein the material is selected from the group consisting essentially of hardwood and softwood wood chips.

6. A method of controlling the feed of comminuted cellulosic fibrous material to a continuous digester using a material meter of variable speed, comprising the steps of:

(a) substantially continuously feeding comminuted cellulosic fibrous material from the material meter to the continuous digester;

(b) during the practice of step (a), substantially continuously determining the density of the material being fed while it is in free fall, not immersed in liquid; and (c) substantially continuously controlling the speed of the material meter in response to step (b) to provide a target density of material fed from the meter to the continuous digester.

7. A method as recited in claim 6 wherein step (b) is practiced utilizing a chute having a level of liquid therein, and comprising the further steps of sensing the level of liquid in the chute with a level sensor, and shielding the level sensor from the nuclear particles.

8. A method as recited in claim 7 wherein step (c) is practiced to control the material meter speed so that it is in the range of 0–16 rpm.

* * * * *